US010147282B2

(12) United States Patent
Meyer

(10) Patent No.: US 10,147,282 B2
(45) Date of Patent: Dec. 4, 2018

(54) ELECTRONIC GAMING MACHINE AND GAMING METHOD

(71) Applicant: AINSWORTH GAME TECHNOLOGY LIMITED, Newington, NSW (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 1069 days.

(21) Appl. No.: 14/499,571

(22) Filed: Sep. 29, 2014

(65) Prior Publication Data

US 2015/0310699 A1 Oct. 29, 2015

(30) Foreign Application Priority Data

Apr. 24, 2014 (AU) ..... 2014901496
Aug. 14, 2014 (AU) ..... 2014903169

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC .... G07F 17/32; G07F 17/3213; G07F 17/326; G07F 17/34
See application file for complete search history.

(56) References Cited

U.S. PATENT DOCUMENTS 6,270,412 B1 * 8/2001 Crawford ..... G07F 17/3265 273/143 R
7,371,171 B1 * 5/2008 Englman ..... G07F 17/3244 273/138.2
2006/0068881 A1 * 3/2006 Casey ..... G07F 17/3265 463/20
2009/0305770 A1 * 12/2009 Bennett ..... G07F 17/32 463/20
2013/0252699 A1 * 9/2013 Nauman ..... G07F 17/3265 463/20

FOREIGN PATENT DOCUMENTS

AU 771762 2/2002

* cited by examiner

*Primary Examiner* — Jasson Yoo
(74) *Attorney, Agent, or Firm* — Cook Alex Ltd.

(57) ABSTRACT

An electronic gaming machine includes a display for displaying a game and an electronic game controller for controlling the display of said game symbols on said display. The game includes game symbols arranged into a first array of symbol positions. The electronic game controller causes the display of a second array for displaying at least one special symbol in a symbol position that visually appears greater in size than said symbol positions of said first array, the at least one special symbol resulting in the award of one of more game enhancing elements. The at least one special symbol is randomly selected by said electronic game controller and is different to said game symbols displayed in said first array. A gaming method is also provided.

7 Claims, 8 Drawing Sheets

ELECTRONIC GAMING MACHINE AND GAMING METHOD

BACKGROUND

The present invention relates to an electronic gaming machine and in a particular an electronic gaming machine having a base game and a feature game. The invention has been developed primarily for use as an electronic gaming machine and will be described hereinafter by reference to this application The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, computational processor or other central processing unit, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may also be provided by an electronic gaming machine in addition to a base or main game. Typically feature games use the same set of reels as the main game and are limited to a set of free games operated under a single set of rules. This means that the feature game is restricted by the same set of rules, and so there is no variation in the play of the feature game. Consequently, it is difficult to retain player interest because there is no apparent incentive for the player to continue playing the same electronic gaming machine once the player becomes familiar with the feature game and the main game. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

It is an object of the invention in at least one preferred embodiment to provide an electronic gaming machine and a gaming method for an electronic gaming machine that encourages player interest.

SUMMARY

According to a first aspect of the present invention, there is provided an electronic gaming machine comprising:

a display for displaying a game, wherein said game comprises game symbols arranged into a first array of symbol positions displaying randomly selected game symbols, and where predetermined winning combinations of game symbols in said game award prizes to a player; and an electronic game controller for controlling the display of said game symbols for said game on said display, wherein said electronic game controller causes the display of a second array for displaying at least one special symbol in a symbol position that visually appears greater in size than said symbol positions of said first array, said at least one special symbol resulting in the award of one of more game enhancing elements upon the player;

wherein said at least one special symbol is randomly selected by said electronic game controller; and wherein said at least one special symbol is different to said game symbols displayed in said first array.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

A second aspect of the present invention provides an electronic gaming machine comprising:

a housing having a display for displaying a game and an electronic game controller for controlling the display of game symbols on said display, wherein said game comprises game symbols arranged into a first array of symbol positions displaying randomly selected game symbols, and where predetermined winning combinations of randomly selected game symbols in said game award prizes to a player; and an input means for receiving commands from said player to operate said electronic gaming machine and initiate play of said game on said display, said input means being in electronic communication with said electronic game controller;

wherein said electronic game controller in response to a command from said player via said input means commences play of said game by randomly selecting game symbols and transmitting a signal to said display to display said randomly selected game symbols in said symbol positions on said array;

wherein said electronic game controller transmits a signal to said display to display a second array for displaying at least one special symbol in a symbol position that visually appears greater in size than said symbol positions of said first array, said at least one special symbol resulting in the award of one of more game enhancing elements upon the player;

wherein said at least one special symbol is randomly selected by said electronic game controller; and wherein said at least one special symbol is different to said game symbols displayed in said first array.

Preferably, said at least one special symbol modifies the result of a play of said game.

Preferably, the type of special symbols displayed in said second array vary according to the amount of a bet wagered by said player to play said game on said first array.

Alternatively, it is preferred that said electronic game controller selects said at least one special symbol from a set of special symbols, said special symbol set comprising different types of special symbols and multiple special symbols of the same type, and wherein said types and number of said special symbols vary according to the amount of a bet wagered by said player to play said game on said first array. More preferably, said different types of special symbols award different game enhancing elements.

Preferably, said at least one special symbol comprises at least one or more of a symbol that awards a predetermined number of free plays of said game, a win multiplier symbol that multiplies the amount of any win from one of said predetermined winning combinations, a wild symbol that causes the display of substitute symbols in randomly selected symbol positions, a wild multiplier symbol that causes the display of substitute symbols on said first array and multiplies the amount of any win from one of said predetermined winning combinations, a bonus wild symbol that causes the display of substitute symbols on said first array and awards a bonus prize, a symbol that causes the award of additional free plays of said game, a symbol that causes one or more of said symbol positions to be held static and display substitute symbols, a symbol that causes the same game symbol to be stacked in a group of symbol positions, a symbol that causes the display of new game symbols, a reveal symbol that causes a game symbol to reveal another game symbol, a bonus or jackpot symbol that results in the award of a bonus, jackpot or progressive jackpot prize, and a replacement symbol that causes one or more game symbols to be replaced by other game symbols in the first array.

In some embodiments, said at least special symbol comprises a win multiplier symbol that multiplies the amount of any win from one of said predetermined combinations displayed on said first array by an integer. In one particularly preferred embodiment, wherein said integer comprises a number selected from 2 to 10, In some embodiments, said at least special symbol comprises a bonus or jackpot symbol that is associated with the award of a bonus prize, jackpot prize or a progressive jackpot prize.

In some embodiments, said at least special symbol comprises a replacement symbol that results in changing one or more of said game symbols displayed on said first array into other game symbols.

Preferably, said symbol positions of said first array are arranged into rows and columns.

Preferably, said second array is located above said first array on said display.

Preferably, the probability of said at least one special symbol appearing on said second array is related to the amount of a bet wagered by said player to play said game on said first array. In one preferred form, said probability of said at least one special symbol appearing on said second array is proportional to said bet amount.

Preferably, said game comprises a base game and a feature game, and said electronic game controller causes the display of said second array in said feature game. In this case, it is preferred that a trigger event in said base game triggers said feature game. Preferably, said trigger event is randomly determined by said electronic game controller. Alternatively, said trigger event is preferably a player-actuated trigger event.

Preferably, said symbol position of said second array does not define a pay line with any of said symbol positions on said first array.

Preferably, said input means comprises one or more buttons on said housing, said buttons being in electronic communication with said electronic game controller to transmit player commands to said electronic game controller. More preferably, said buttons are arranged on a console of said housing. Alternatively or additionally, said input means comprises a touch sensitive surface on said display for receiving player commands, said touch sensitive surface being in electronic communication with said electronic game controller to transmit player commands to said electronic game controller.

Preferably, said housing comprises a value transfer mechanism for paying said prizes to said player using value in an amount equal to an awarded prize. More preferably, said value transfer mechanism also receives value from said player to initiate said bet. In one embodiment, said value transfer mechanism comprises one or more vending slots for paying and/or receiving value. In other embodiments, said value transfer mechanism comprises a value input/value output device. In further embodiments, said value transfer mechanism comprises a coin slot or acceptor, a paper currency acceptor, a ticket reader and/or printer or a card reader and/or writer.

Throughout the specification and unless explicitly stated otherwise, the term "value" means credits, gaming tokens, coins, paper, currency, tickets, vouchers, credit cards, debit cards, smart cards, memory devices capable of storing value and any other object representative of value.

Preferably, the electronic gaming machine comprises a mobile electronic gaming device. More preferably, said mobile electronic gaming device comprises a handheld electronic device. In one preferred form, said handheld electronic device comprises a handheld electronic gaming device or a smart phone. Alternatively, said electronic gaming machine comprises a computer. More preferably, said computer is connected to a communication network.

According to a third aspect of the present invention, there is provided an electronic gaming machine comprising:

a display for displaying a game, wherein said game comprises game symbols displayed in one or more symbol positions arranged into a plurality of reels, where predetermined winning combinations of said game symbols in said game award prizes to a player; and an electronic game controller for controlling the display of said game symbols in said game on said display;

wherein said electronic game controller randomly determines whether to display at least one special symbol in said game;

wherein the appearance of said at least one special symbol in at least one reel of said plurality of reels in a play of said game causes the display of an indicator associated with said at least one reel for one or more subsequent plays of said game; and wherein a trigger event in said one or more subsequent plays causes at least one game symbol in said at least one reel associated with said indicator to be replaced by another special symbol.

A fourth aspect of the present invention provides an electronic gaming machine comprising:

a housing having a display for displaying a game and an electronic game controller for controlling the display of game symbols in said game on said display, wherein said game comprises game symbols displayed in one or more symbol positions arranged into a plurality of reels, where predetermined winning combinations of game symbols in said game award prizes to a player; and an input means for receiving commands from said player to operate said electronic gaming machine and initiate play of said game on said display, said input means being in electronic communication with said electronic game controller;

wherein said electronic game controller in response to a command from said player via said input means commences play of said game by randomly selecting game symbols and transmitting a signal to said display to display said randomly selected game symbols in said symbol positions on said reels;

wherein said electronic game controller randomly determines whether to display at least one special symbol in said game;

wherein the appearance of said at least one special symbol in at least one reel of said plurality of reels in a play of said game causes said electronic game controller to transmit a signal to said display to display an indicator associated with said at least one reel for one or more subsequent plays of said game;

said electronic game controller randomly determines whether a trigger event is to occur in said one or more subsequent plays; and whereupon the occurrence of said trigger event, said electronic game controller transmits a signal to said display to replace at least one game symbol in said at least one reel associated with said indicator with another special symbol.

Preferably, at least one special symbol appears in two or more reels of said plurality of reels in said play, and said electronic game controller causes the display of indicators respectively associated with each of said two or more reels for said one or more subsequent plays and causes at least one game symbol in each of said two or more reels to be replaced by said another special symbol.

Preferably, said at least one game symbol is not a scatter symbol.

Preferably, said at least one game symbol comprises all the game symbols in each symbol position of said at least one reel.

Preferably, said another symbol comprises a substitute symbol. More preferably, said substitute symbol also multiplies by an integer any award given by said electronic gaming machine for a winning combination of game symbols that includes said substitute symbol.

Alternatively, said another special symbol comprises said at least one special symbol.

Preferably, said electronic game controller causes said display to display a bonus reel separate to said reels, said trigger event comprising the appearance of said at least one special symbol in said bonus reel. More preferably, said bonus reel comprises a symbol position that visually appears greater in size than said symbol positions of said reels.

Preferably, said trigger event comprises the appearance of three scatter symbols. Alternatively, said trigger event comprises the award of additional plays of said game.

Preferably, said game comprises a base game and a feature game, wherein said play comprises a play of a base game and said one of more subsequent plays comprise plays of said feature game.

The third and fourth aspects of the invention also preferably have the preferred features of the first and second aspects of the invention stated above, where applicable.

According to a fifth aspect of the invention, there is provided an electronic gaming method for an electronic gaming machine comprising a display and an electronic game controller, said method comprising said electronic game controller:

controllably displaying game symbols on said display to play a game wherein predetermined winning combinations of game symbols in said game award prizes to a player;

arranging said game symbols into a first array of symbol positions;

randomly selecting said game symbols for display in said symbol positions;

causing the display of a second array for displaying at least one special symbol in a symbol position that visually appears greater in size than said symbol positions of said first array, said at least one special symbol resulting in the award of one of more game enhancing elements upon the player; and randomly selecting said at least one special symbol, wherein said at least one special symbol is different to said game symbols displayed in said first array.

A sixth aspect of the present invention provides an electronic gaming method for an electronic gaming machine comprising a housing having a display for displaying a game and an electronic game controller for controlling the display of game symbols on said display, wherein said game comprises game symbols displayed in a first array of symbol positions and where predetermined winning combinations of game symbols in said game award prizes to a player; and an input means for receiving commands from said player to operate said electronic gaming machine and initiate play of said game on said display, said input means being in electronic communication with said electronic game controller, the method comprising the steps of:

said electronic game controller receiving a command from said player via said input means;

said electronic game controller commencing a play of said game by randomly selecting game symbols and transmitting a signal to said display to display said randomly selected game symbols in said symbol positions on said first array;

said electronic game controller transmitting a signal to said display to display a second array, said second array comprising a symbol position that visually appears greater in size than said symbol positions of said first array for displaying at least one special symbol, said display of said at least one special symbol being different to said game symbols displayed in said first array and resulting in the award of one of more game enhancing elements upon the player; and said electronic game controller randomly selecting said at least one special symbol and transmitting a signal to said display to display said at least one special symbol in said symbol position of said second array.

Preferably, said one or more game enhancing elements modify the result of said game on said first array.

Preferably, said method comprises varying the type of special symbols displayed in said second array according to the amount of a bet wagered by said player to play said game on said first array.

Preferably, said method comprises selecting said at least one special symbol from a set of special symbols, said special symbol set comprising different types of special symbols and multiple special symbols of the same type, and varying said types and number of said special symbols according to the amount of a bet wagered by said player to play said game on said first array.

Preferably, said method comprises selecting said at least one special symbol from at least one or more of a symbol that awards a predetermined number of free plays of said game, a win multiplier symbol that multiplies the amount of any win from one of said predetermined winning combinations, a wild symbol that causes the display of substitute symbols in randomly selected symbol positions, a wild multiplier symbol that causes the display of substitute symbols on said first array and multiplies the amount of any win from one of said predetermined winning combinations, a bonus wild symbol that causes the display of substitute symbols on said first array and awards a bonus prize, a symbol that causes the award of additional free plays of said game, a symbol that causes one or more of said symbol positions to be held static and display substitute symbols, a symbol that causes the same game symbol to be stacked in a group of symbol positions, a symbol that causes the display of new game symbols, a reveal symbol that causes a game symbol to reveal another game symbol, a bonus or jackpot symbol that results in the award of a bonus, jackpot or progressive jackpot prize, and a replacement symbol that causes one or more game symbols to be replaced by other game symbols in the first array.

In some embodiments, said method comprises selecting a win multiplier symbol as said at least one special symbol, wherein the amount of any win from one of said predetermined combinations displayed on said first array is multiplied by an integer. In a particularly preferred embodiment, said method comprises selecting a number from 2 to 10 as said integer.

In some embodiments, said method comprises selecting a bonus or jackpot symbol as said at least one special symbol, wherein said bonus or jackpot symbol is associated with the award of a bonus prize, jackpot prize or a progressive jackpot prize.

In some embodiments, said method comprises selecting a replacement symbol as said at least one special symbol, wherein said replacement symbol results in changing one or more of said game symbols displayed on said first array into other game symbols.

Preferably, said arranging step comprises arranging said symbol positions into rows and columns.

Preferably, said method comprises locating said second array above said first array on said display.

Preferably, said method comprises the probability of said at least one special symbol appearing on said second array is related to the amount of a bet wagered by said player to play said game on said first array. In one preferred form, said probability of said at least one special symbol appearing on said second array is proportional to said bet amount.

Preferably, said game comprises a base game and a feature game and said causing step comprises displaying said second array in said feature game. In this case, it is preferred that a trigger event in said base game triggers said feature game.

Preferably, said method comprises displaying said symbol position of said second array so that it does not define a pay line with any of said symbol positions on said first array.

The methods of the fifth and sixth aspects also preferably have the preferred features of the first and second aspects of the invention stated above, where applicable.

According to a seventh aspect of the present invention, there is provided an electronic gaming method for an electronic gaming machine comprising a display and an electronic game controller, said method comprising said electronic game controller:

controllably displaying game symbols on said display to play a game wherein, predetermined winning combinations of said game symbols in said game award prizes to a player; and displaying said game symbols in one or more symbol positions arranged into a plurality of reels;

randomly selecting said game symbols for display in said symbol positions;

randomly determining whether to display at least one special symbol in a play of said game;

displaying an indicator for one or more subsequent plays of said game in response to the appearance of said at least one special symbol in at least one reel of said plurality of reels in a play of said game, said indicator being associated with said at least one reel;

randomly determining whether a trigger event is to occur in said one or more subsequent plays; and replacing at least one game symbol in said at least one reel associated with said indicator with another special symbol in response to the occurrence of said trigger event.

According to an eighth aspect of the invention, there is provided an electronic gaming method for an electronic gaming machine comprising a housing having a display for displaying a game and an electronic game controller for controlling the display of game symbols on said display, wherein said game comprises game symbols displayed in one or more symbol positions arranged in a plurality of reels and where predetermined winning combinations of game symbols in said game award prizes to a player; and an input means for receiving commands from said player to operate said electronic gaming machine and initiate play of said game on said display, said input means being in electronic communication with said electronic game controller, the method comprising the steps of:

said electronic game controller receiving a command from said player via said input means;

said electronic game controller commencing a play of said game by randomly selecting game symbols and transmitting a signal to said display to display said randomly selected game symbols in said symbol positions on said reels;

wherein said electronic game controller in response to a command from said player via said input means commences play of said game by randomly selecting game symbols and transmitting a signal to said display to display said randomly selected game symbols in said symbol positions on said reels, said electronic game controller randomly determining whether to display at least one special symbol in a play of said game;

said electronic game controller transmitting a signal to said display to display an indicator for one or more subsequent plays of said game in response to the appearance of said at least one special symbol in at least one reel of said plurality of reels in said play, said indicator being associated with said at least one reel;

said electronic game controller randomly determining whether a trigger event is to occur in said one or more subsequent plays; and transmitting a signal to said display to replace at least one game symbol in said at least one reel associated with said indicator with another special symbol in response to the occurrence of said trigger event.

Preferably, said method comprises said electronic game controller randomly determining whether to display at least one special symbol in two or more reels of said plurality of reels in said play, transmitting a signal to said display to display indicators respectively associated with each of said two or more reels for said one or more subsequent plays and transmitting a signal to said display to replace at least one game symbol in each of said two or more reels.

Preferably, said at least one game symbol is not a scatter symbol.

Preferably, said method comprises replacing all the game symbols in each symbol position of said at least one reel.

Preferably, said at least one special symbol comprises a substitute symbol. More preferably, said method comprises multiplying by an integer any award given by said electronic gaming machine for a winning combination of game symbols that includes said substitute symbol.

Preferably, said method comprises said electronic game controller transmitting a signal to said display to display a bonus reel separate to said reels, wherein said trigger event comprises the appearance of said at least one special symbol in said bonus reel.

The methods of the seventh and eighth aspects of the invention also preferably have the preferred features of the fifth and sixth aspects of the invention stated above, where applicable.

According to a ninth aspect of the invention, there is provided a gaming system comprising a central processing unit configured for communication with an electronic gaming machine, wherein said gaming system is configured to perform the method of the fifth, sixth, seventh or eighth aspect of the invention on said electronic gaming machine.

According to a tenth aspect of the invention, there is provided a computer program configured to perform the method of the fifth, sixth, seventh or eighth aspect of the invention.

According to a eleventh aspect of the invention, there is provided a non-transitory carrier medium carrying computer executable code that, when executed on a central processing unit configured for communication with an electronic gaming machine, causes the central processing unit to perform the method of the fifth, sixth, seventh or eighth aspect of the invention on said electronic gaming machine.

BRIEF DESCRIPTION OF THE DRAWINGS

Preferred embodiments of the invention will now be described, by way of example only, with reference to the accompanying drawings in which.

DETAILED DESCRIPTION OF THE VARIOUS EMBODIMENTS

Figure 1:
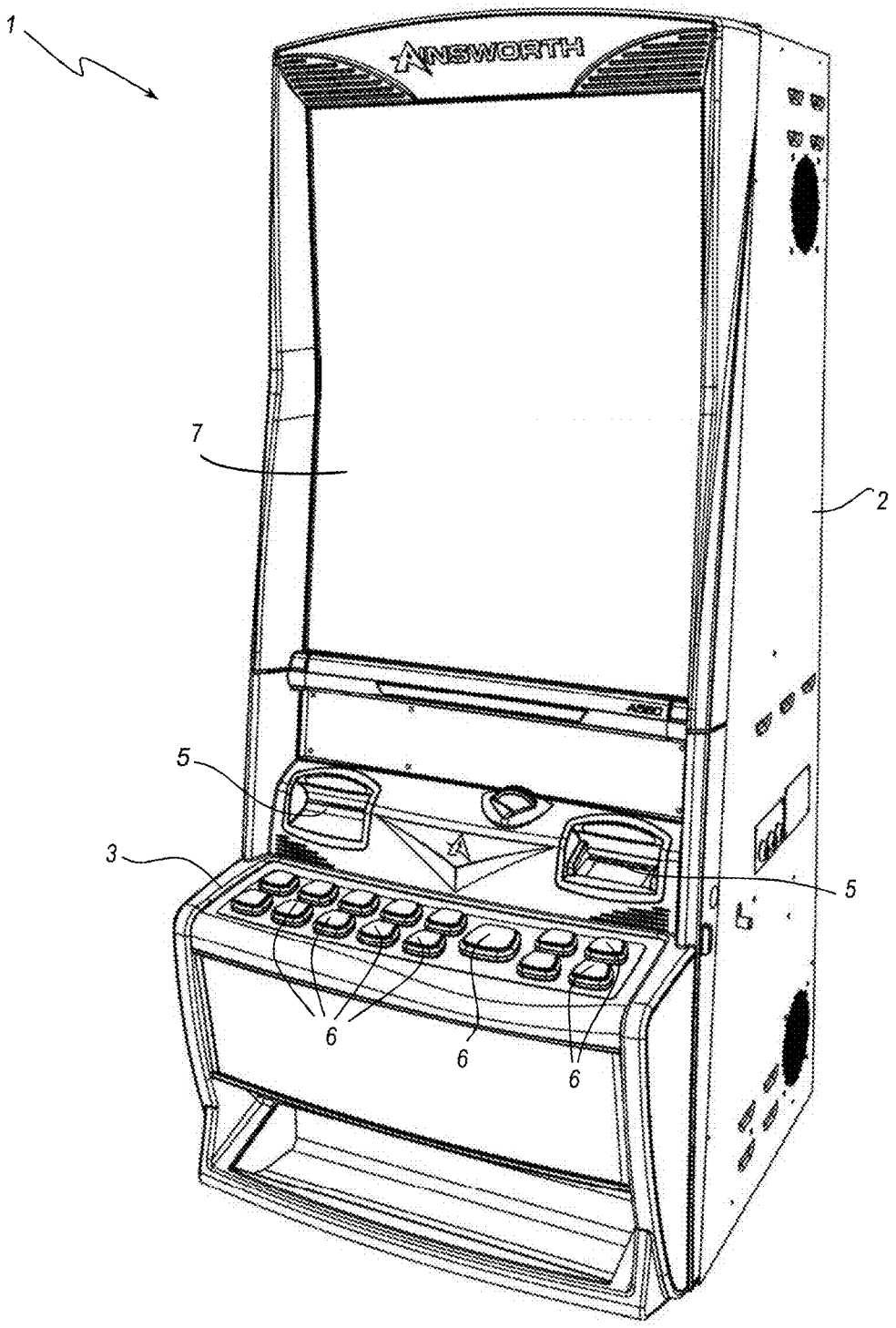
FIG. 1 is a perspective view of an electronic gaming machine according to one embodiment of the invention.

The present invention will now be described with reference to the following examples which should be considered in all respects as illustrative and non-restrictive. Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. It will be appreciated that in other embodiments the vending slots may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the electronic gaming machine 1. Other forms of value include gaming tokens, paper, tickets, vouchers, and any other object representative of value.

Figure 2:
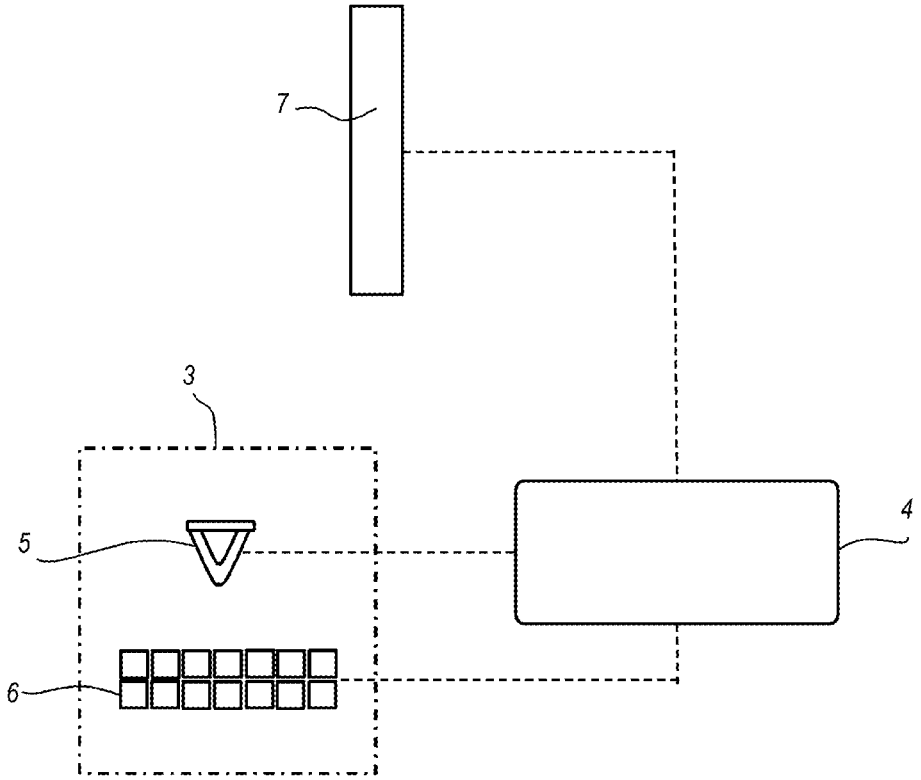
FIG. 2 is a schematic drawing of an electronic game controller for the electronic gaming machine of FIG. 1.

The electronic game controller 4 is generally in the form of a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store program instructions and transient data related to the operation of the electronic game controller and hence the electronic gaming machine 1. The RAM contains a body of program instructions for implementing a game on the electronic gaming machine 1, as discussed in more detail below. The central processing unit or processor may also be operatively associated with a further storage device, such as a hard disk drive, which is used for long-term storage of program components and data relating to the electronic game controller 4 and/or the electronic gaming machine 1, including a database for game performance data, as well as information gathered from users. It is also appreciated that a person skilled in the art would readily understand the location and use of the electronic game controller 4 in the electronic gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the electronic gaming machine 1. If not, the electronic game controller 4 will send a signal to the display 7 to show a message requesting further value to be added to the electronic gaming machine.

Figure 3:
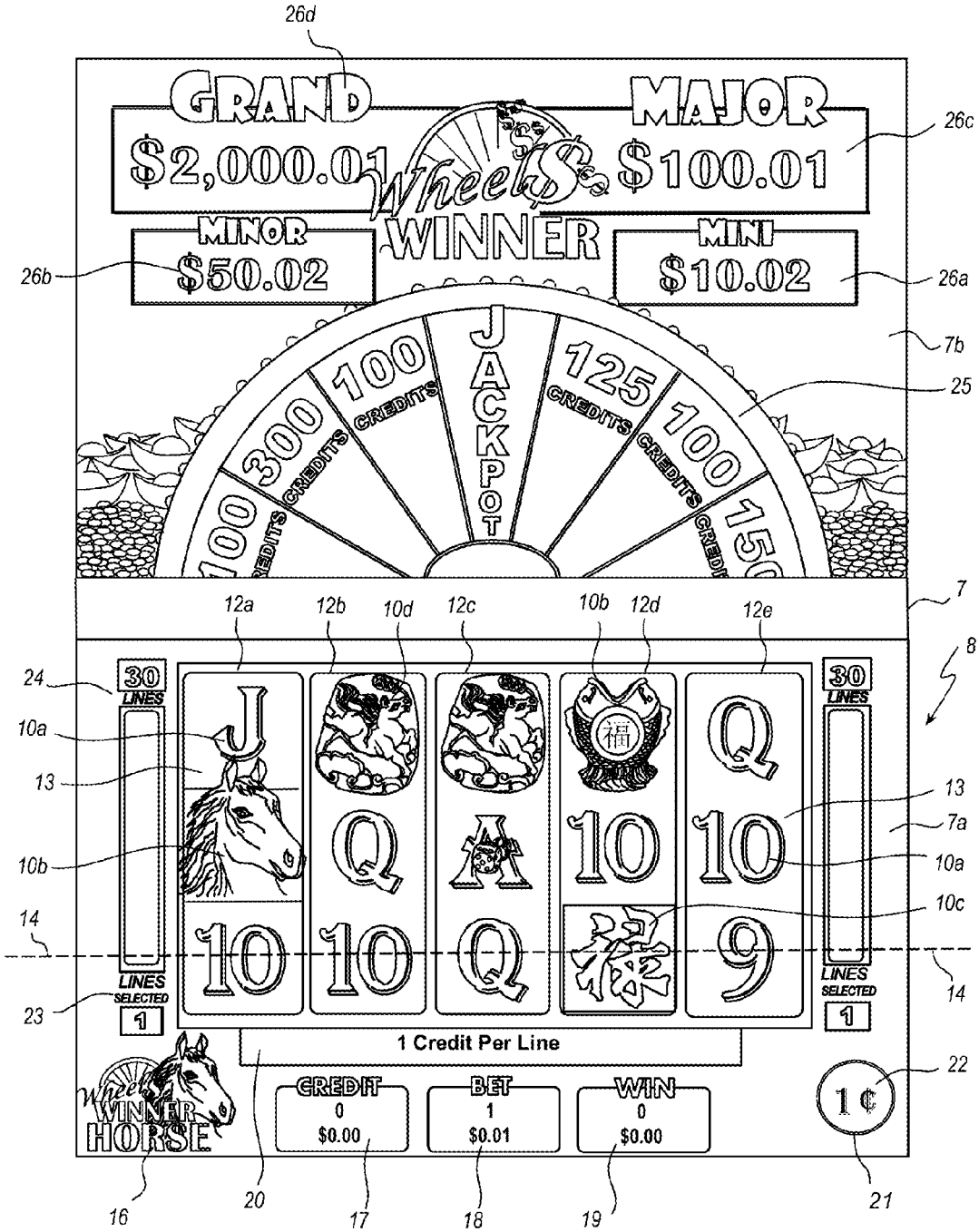
FIG. 3 is a simulated screen shot of the display of the electronic gaming machine of FIG. 1 illustrating a base game.
Figure 4:
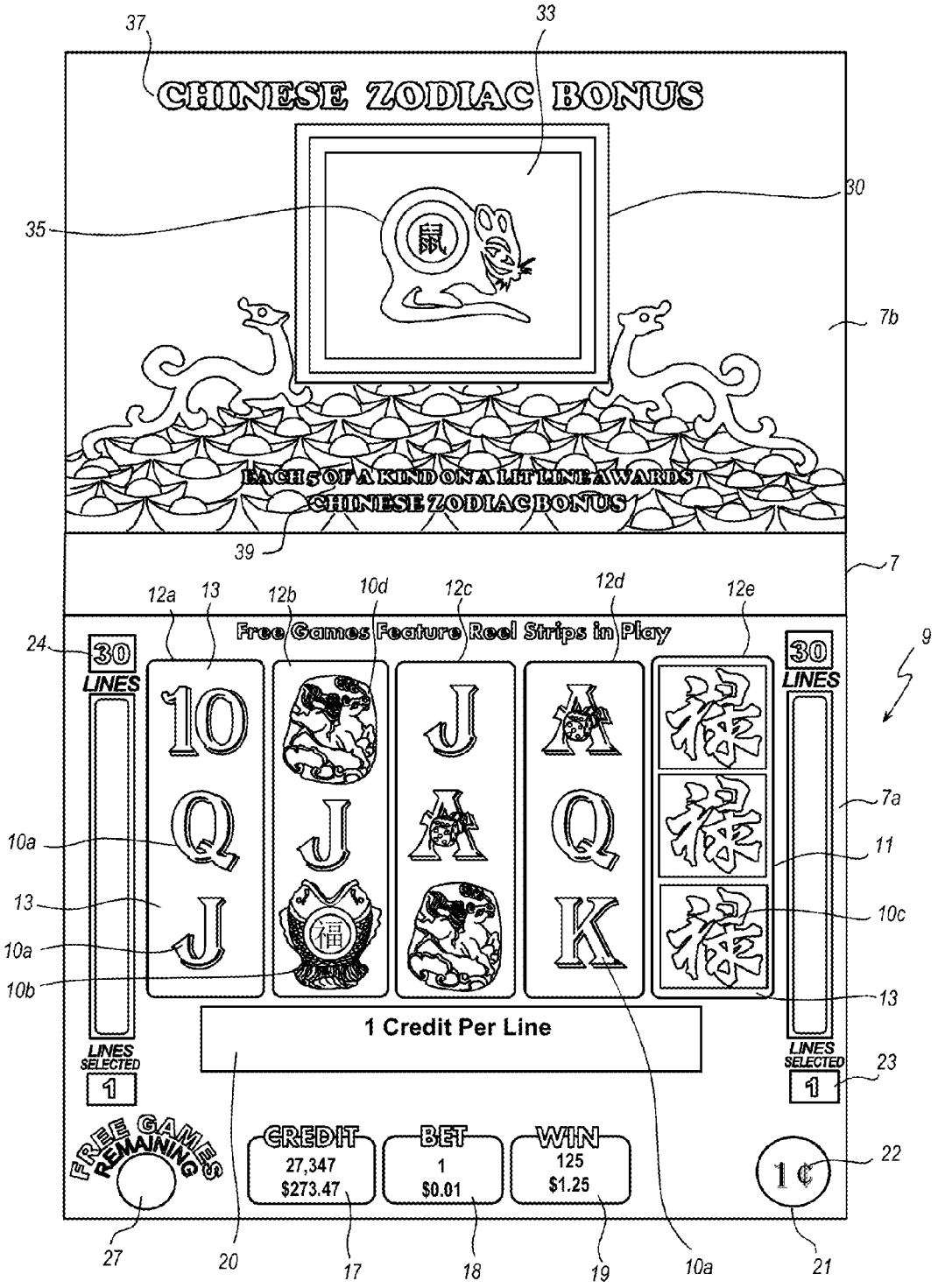
FIG. 4 is a simulated screen shot of the display of the electronic gaming machine of FIG. 1 illustrating a feature game.

The electronic game controller 4 is programmed to provide a game in the form of a base game 8 (as best shown in FIG. 3) and a feature game 9 (as best shown in FIG. 4) on the electronic gaming machine 1 for play by a player. The base game 8 has game symbols 10 arranged into an array 11 in the form of five columns or "reels" 12 that are displayed in a lower area 7*a* of the display 7, as best shown in FIG. 3. The reels 12 give the visual appearance of rotating, typically by having the game symbols 10 move in a downward linear path along the length of each reel 12. While the array 11 is arranged with five reels 12 and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the display screen 7, including showing the game symbols 10, array 11, reels 12 and other visible elements of the base game and feature game, as discussed in more detail below.

The array 11 of the base game 8 defines game positions or symbol positions 13, in which the game symbols 10 appear. The game or symbol positions 13 are not visually marked by boundary lines and simply provide an area for the game symbols 10 to appear. However, it will be appreciated that in other embodiments, the game or symbol positions 13 are defined by visible boundary lines (to define "squares" or cells) or other markings to define each respective area of the symbol positions.

The array 11 is arranged so that a player can select one or more predetermined "pay lines" 14 defined around the array, which correspond to combinations of the game positions or symbol positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 appearing on the same pay line 14 result in the award of prizes to the player.

The game symbols 10 can include a mixture of picture symbols (such as animal symbols or playing card symbols), word symbols, scatter symbols, substitute symbols and trigger symbols to trigger the feature game 9. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. A trigger symbol is a symbol that triggers a game event or confers an award, where the trigger symbol may or may not have to appear in combination and may or may not have to appear on the same player-selected pay line 14. In this embodiment, the game symbols 10 include playing card symbols 10*a*, item-themed or picture symbols 10*b*, a substitute symbol in the form of Chinese character symbol 10*c* and a scatter symbol in the form of a jade horse symbol 10*d*. The electronic game controller 4 randomly determines the appearance of the game symbols 10 on the array 11 and then sends an appropriate signal to the display screen 7 to cause the display of the game symbols 10 on the array 11.

The video screen 7 also displays standard game information adjacent the array 11 in a lower screen area 7*a*. The standard game information includes name of the game 16, the amount of player credits 17, the amount of the current bet wagered by the player 18, the amount of wins by the player 19, a message area 20, and a current denomination button 21 indicating the currently selected base bet denomination 22, the number of pay lines available 23 and the number of player-selected pay lines 24.

In the base game 8, the player initially makes a bet using vending slots 5 to initiate play of the electronic gaming machine 1 by building up credit to play the base game on the electronic gaming machine. The player can bet or wager monetary amounts equivalent to a particular amount of credits, depending on the bet denomination selected for the base game. For example, the player can bet or wager 50 credits to play 10 pay lines or 200 credits to play 50 pay lines. Also, the player can make any additional side bets or ante-bets to access additional features in the base game 8, such as increasing the number of winning combinations in the game.

Typically, electronic gaming machines offer a number of preset bet options that the player can make, and these bet options can vary depending on the game or games offered on the electronic gaming machine. For example, a game on an electronic gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc. The electronic gaming machine 1 also offers a variety of bet denominations of 1¢, 2¢, 5¢ and 10¢ for the base game 8.

The electronic gaming machine also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the electronic gaming machine has not yet been played or has been started up, the default bet denomination is initially selected by the electronic game controller 4. The default bet denomination can be randomly selected or chosen according to a predetermined order. Typically, the electronic game controller 4 will select the bet denomination with the lowest value that is available for the base game 8, which would be the 1¢ bet denomination for this embodiment. The player may change the bet denomination at any time in the base game 8 by touching the denomination button before or after the reels 12 have spun.

The electronic game controller 4 then transmits a signal to the display 7 to cause the reels 12 to appear to visibly rotate or "spin" in a linear path, typically in a downward vertical direction, and randomly display the game symbols 10 in each symbol position 13 for each play of the array 11 for the base game 8. After the reels 12 stop spinning, the electronic game controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 10 can also be provided. If so, the gaming machine 1 enters a winning game state and awards a prize according to the displayed predetermined winning combination.

The base game 8 also includes a jackpot prize feature separate to the feature game 9, where a trigger symbol (not shown) activates a wheel 25 which can award a jackpot prize 26*a* to 26*d*, depending on the bet initially made by the player to play the base game 8. The higher the amount of the bet, the higher the jackpot prize that can be won. As best shown in FIG. 3, the jackpot prizes comprise progressive jackpots including a mini jackpot 26*a*, minor jackpot 26*b*, major jackpot 26*c* and grand jackpot 26*d*. The mini jackpot 26*a* has the lowest value and the grand jackpot 26*d* has the highest value. The progressive jackpot prizes 26*a* to 26*d* are typically confined to the electronic gaming machine 1. However, in another preferred form, the progressive jackpot prizes 26*a* to 26*d* are configured to be part of a wide area or in-house linked progressive jackpot prize. In other words, the progressive jackpot prizes 26*a* to 26*d* can be awarded on a group of networked gaming machines in a specified area or a group of specified electronic gaming machines that are linked together for jackpot purposes. The jackpot prizes can also be shared with any other games offered on the same electronic gaming machine 1 (as in multi-game gaming machines).

In addition, the electronic game controller 4 randomly determines whether a predetermined trigger event has occurred which triggers the feature game 9 on the electronic gaming machine 1. In this embodiment, the trigger event is the appearance of three jade horse scatter symbols 10*d* anywhere on the reels 12 without having to be on a player-selected pay line 14. The electronic game controller 4 then causes the feature game 9 to be shown on the lower area 7*a* of the screen 7, as best shown in FIG. 4.

The feature game 9 uses the same array 11, reels 12*a* to 12*e*, game symbols 10, symbol positions 13 and pay lines 14 as in the base game 8. In the feature game 9, a number of free plays or spins of the reels 12 are awarded to the player, with the number of free spins being indicated in a counter 27. It will be understood by those skilled in the art that free plays or spins are commonly referred to as "free games". The feature game 9 also provides a second array 30 that the electronic game controller 4 causes to be displayed in the upper area 7*b* of the video display screen 7 above the array 11, as best shown in FIG. 4. The second array 30 is in the form of a bonus reel that awards a game enhancing element upon the player via a special symbol 35 and comprises a single symbol position or symbol position 33 that is visually larger in size compared to the size of the symbol positions 13 in the array 11 of the base game 8 or the feature game 9. The bonus reel 30 is indicated by the "Chinese Zodiac Bonus" title 37 and randomly selects the special symbol 35 to display in the oversized symbol position 33. In this embodiment takes the form of a stylised Chinese zodiac symbol 35. FIG. 4 shows the display of a Gold Rat Chinese zodiac symbol 35, but other special symbols can be displayed, including Gold Ox, Gold Tiger, Gold Rabbit, Gold Dragon and Gold Snake Chinese zodiac symbols.

The bonus reel 30 spins at the same time as each free spin of the reels 12*a* to 12*e* in the feature game 9. In some embodiments, the reels 12*a* to 12*e* in the array 11 stop sequentially and the bonus reel 30 stop spinning only when all the reels 12*a* to 12*e* array 11 have completed their spins. This sequentially stopping with the bonus reel 30 stopping last builds anticipation within the player and causes him or her to focus on the outcome of the spin of the bonus reel, enhancing the player's interest and excitement.

The electronic game controller 4 then causes any prizes to be paid out for any predetermined winning combinations of game symbols 10 that appear on any selected pay lines 14 in the reels 12 of the array 11. This concludes a play or spin of the feature game 9, unless one of the predetermined combination of game symbols 10 triggers the award of the game enhancing element conferred by the special symbol 35 displayed on the bonus reel 30.

If such a qualifying predetermined combination of game symbols appears in the reels 12*a* to 12*e*, then the player receives the game enhancing element awarded by the Chinese zodiac symbol 35 displayed in the enlarged symbol position 33 of the bonus reel 30.

It will also be appreciated that a variety of game enhancing elements can be awarded by the special symbols, including:

- symbols that award a predetermined number of free plays of said game;
- win multiplier symbols that multiply the amount of any win from one of said predetermined winning combinations;
- "wild" symbols that cause the display of substitute symbols in randomly selected symbol positions;
- bonus symbols that awards a bonus prize, either as a monetary amount or as a bonus credit;
- wild multiplier symbols that cause the display of substitute symbols on the array 11 and multiplies the amount of any win from one of said predetermined winning combinations;
- bonus wild symbols that cause the display of substitute symbols on the array 11 and awards a bonus prize;
- symbols that cause the award of additional free plays of said game;
- symbols that cause one or more of said symbol positions to be held static (typically one or more reels 12*a* to 12*e*) and display substitute symbols on the array 11;
- symbols that cause the same game symbol to be stacked in a group of symbol positions, typically the group being one or more reels 12*a* to 12*e;*
- symbols that cause the display of new game symbols on the array 11;
- "reveal" symbols that cause a game symbol to reveal another game symbol;
- "jackpot" symbols that result in the award of a bonus, jackpot or progressive jackpot prize, typically the bonus, jackpot or progressive jackpot prize being awarded upon a certain number of jackpot symbols being accumulated by the player during playing the game; and
- "replacement" symbols that cause one or more game symbols to be replaced by other game symbols in the array 11.

There also may be "blanks" or symbols that do not award any game enhancing element that can appear on the bonus reel 30 to adjust the probability of the special symbol 35 appearing during play of the feature game 9. In other forms, the bonus reel 30 will always display a special symbol that awards a game enhancing element.

Figure 5:
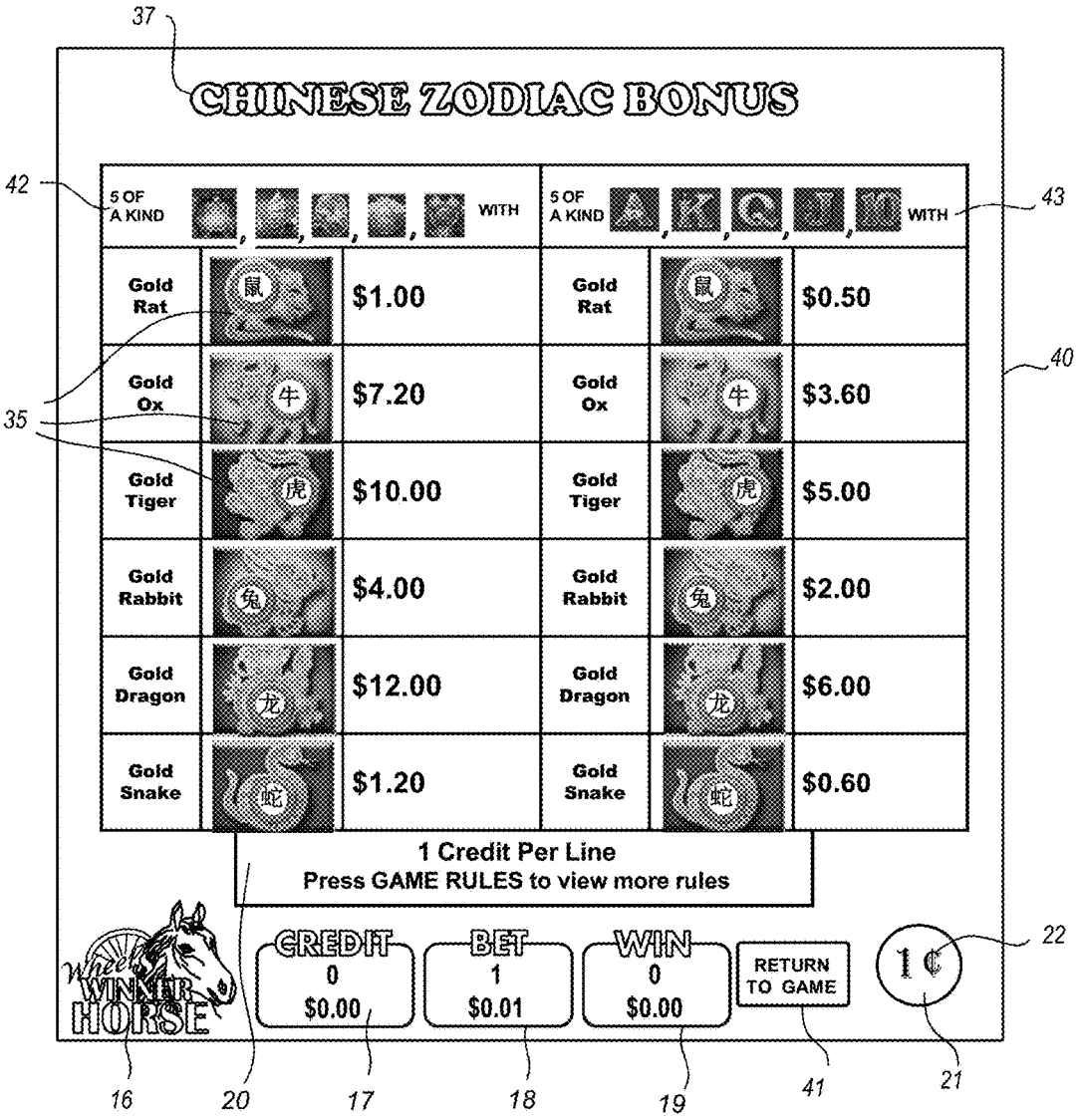
FIG. 5 is a simulated screen shot of the display showing a table indicating the possible special symbols that can be displayed in the bonus reel for the feature game of FIG. 4.

In the embodiment of FIGS. 3 and 4, the qualifying predetermined combination of symbols is five of the same playing card symbols 10*a* or the item or animal themed symbols 10*b* on a player-selected pay line 14 (called a "five of a kind"). This is indicated by the message 39 in the upper screen area 7*b*, as best shown in FIG. 4, and is described in more detail in a table 40 that is accessible by the player through a menu button 41, as best shown in FIG. 5.

The table 40 shows that the Chinese zodiac symbols 35 in this embodiment confer a monetary bonus to any prize awarded for the required predetermined winning combination of game symbols 10 on the reels 12*a* to 12*e* of the array 11. The amount of the monetary bonus depends on which Chinese zodiac symbol 35 appears in the bonus reel 30 and the qualifying combination of game symbols 10 on the reels 12. For example, the Gold Snake symbol awards the highest value bonuses while the Gold Rat awards the lowest value bonuses. Also, the combinations of the item-based symbols 10*b* (as indicated by graphical image 42) result in higher value monetary bonuses conferred by each Chinese zodiac symbol 35 compared to the combinations of the playing card symbols 10*a* (as indicated by graphical image 43). For example, the Gold Rat symbol 35 will award a bonus of $1 for five of a kind of any item-based symbol 10*b* but only a bonus of 50¢ for five of a kind of any playing card symbol 10*a*. Similar differences are shown for each Chinese zodiac symbol 35.

The Chinese zodiac symbols 35 are different in nature to the game symbols 10*a* to 10*d* on the array 11 as they are not combined with the game symbols 10 to form winning combinations but are used to modify the result or play of the game on the array 11. In other words, the special symbols 35 exclude the game symbols 10 used in the array 11. Also, the bonus reel 30 does not have any special symbol 35 that is a substitute for pay lines such as industry known winning patterns like "ways", "anys" or "scatters". Thus, only the array 11 comprises pay lines 14 for determining the predetermined winning combinations of game symbols 10

Also, depending on the type of game enhancing element that has been won on the bonus reel 30, the game enhancing element can be either applied immediately to the game outcome on the array 11 or saved for one or more future games played on the array 11. In another preferred form, the game enhancing symbols may indicate the duration in which its game enhancing element is applied, such as a predetermined number of spins or a predetermined time period.

Figure 6:
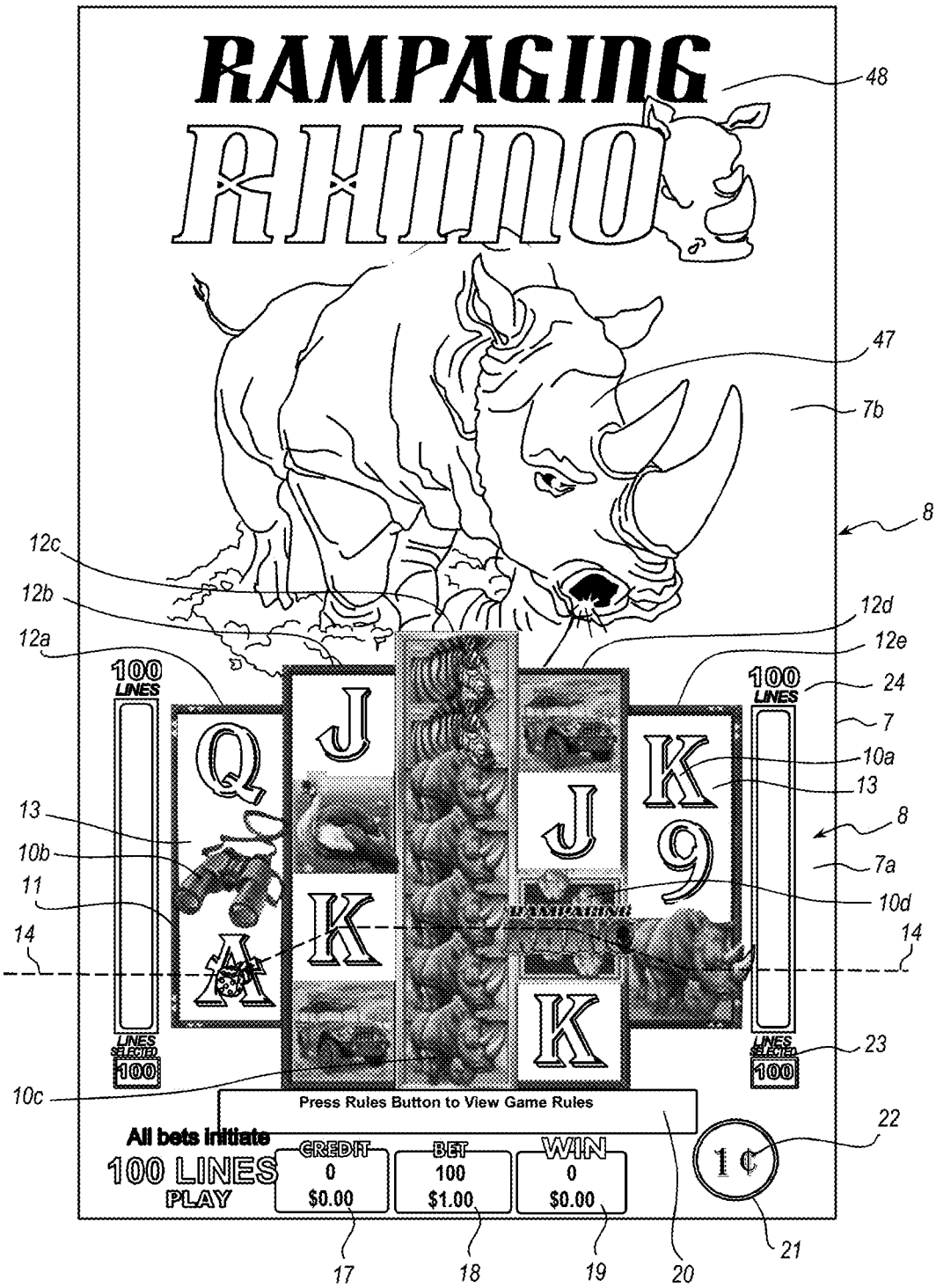
FIG. 6 is a simulated screen shot of the display of an electronic gaming machine according to another embodiment of the invention illustrating a base game.
Figure 7:
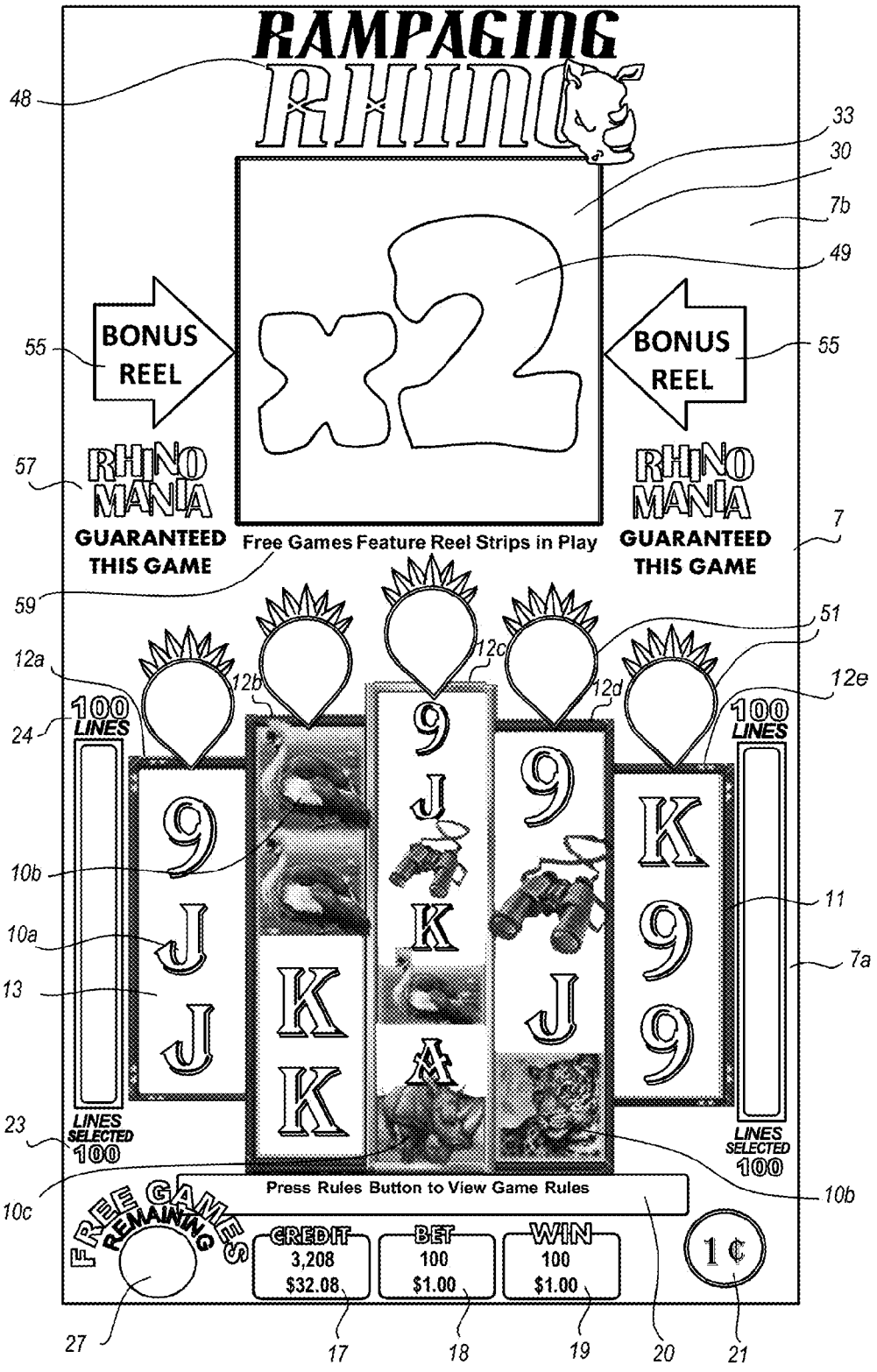
FIGS. 7 and 8 are simulated screen shots of the display of the electronic gaming machine of FIG. 6 illustrating a feature game.
Figure 8:
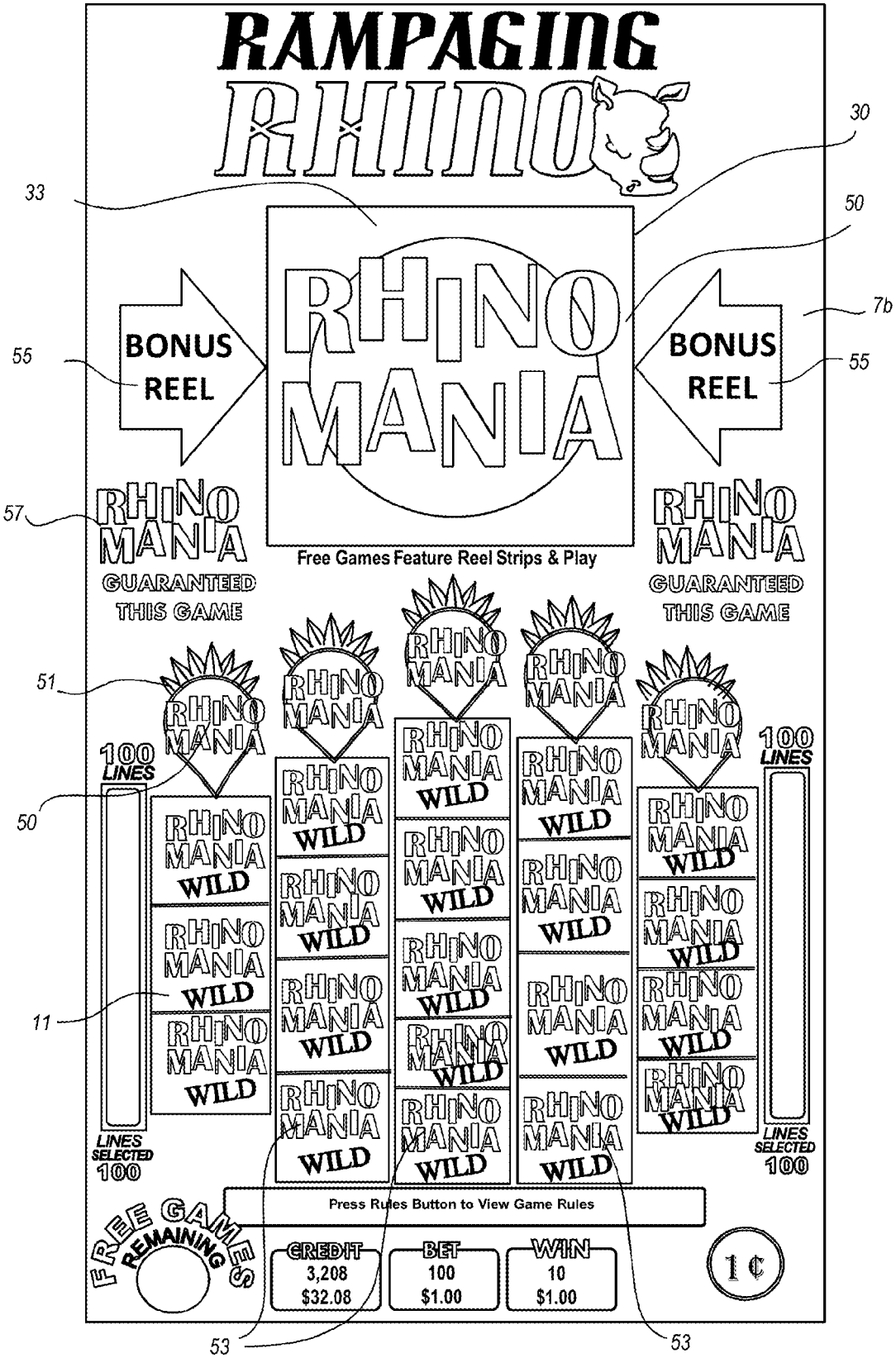

Another base game 8 and feature game 9 according to another embodiment of the invention are illustrated in FIGS. 6 to 8, where corresponding features have been given the same reference numerals. As best shown in FIG. 6, the base game 8 uses an array 11 in the lower screen area 7*a* with five reels 12*a* to 12*e* that have different number of symbol positions 13 in each reel. Reels 12*a* and 12*e* have only three symbol positions 13, reels 12*b* and 12*d* have four symbol positions 13 and the middle reel 12*c* has six symbol positions 13. Pay lines 14 are arranged to have at least one symbol position 13 from each reel 12*a* to 12*e*. Thus, the array 11 can be viewed has having an unequal number of rows with the same number of columns. The upper screen area 7*b* has a graphical image 47 and associated title 48 for the base game 8

The same game symbols 10 are used in base game 8 and feature game 9, and are similar to the game symbols used in the embodiment of FIGS. 3 and 4. However, to match the rhino theme of this embodiment, the picture based symbols 10*b* have an African safari theme, as do the substitute symbol 10*c* and scatter symbol 10*d*.

This embodiment operates in substantially the same way as described in relation to the embodiment of FIGS. 3 and 4. The base game 8 also provides a separate jackpot feature but the jackpot prize comprises a mystery jackpot. That is, none of the symbols in the game trigger the jackpot; hence the triggering event is a "mystery". By way of comparison, a standard jackpot is typically symbol driven in that a particular combination of symbols must occur in the game to trigger the standard jackpot.

The player initiates a play of the base game 8 by making a bet and selecting the number of pay lines 14. The electronic game controller 4 then causes the reels 12*a* to 12*e* to visually spin to simulate rotation of mechanical reels, which then stop either simultaneously or sequentially. The electronic game controller 4 then determines whether any predetermined winning combinations of game symbols 10 appear in the symbol positions 13 of the array 11, and whether the trigger event for the feature game 9 has been triggered.

Where the feature game 9 has been triggered, a number of free spins of the reels 12*a* to 12*e* of the array 11 is provided, as best shown in FIG. 7. Also, the graphical image 47 is replaced with a bonus reel 30 in the upper screen area 7*b*, the bonus reel having a significantly oversized symbol position 33 compared to the symbol positions 13 of the array 11. The bonus reel 30 spins with the reels 12*a* to 12*e* and displays a special symbol 49 that awards a game enhancing element that modifies the result shown on the reels 12*a* to 12*e*. In this embodiment, there are two types of special symbols. One special symbol comprises a win multiplier symbol 49, as best shown in FIG. 7. The win multiplier symbol 49 awards multipliers of double (×2), triple (×3), ×5 and ×10 for any prizes won for predetermined winning combinations of symbols 10 on the reels 12*a* to 12*e* of the array 11. That is, the win multiplier symbol 49 multiplies the value of any prize won on the array 11 by the integer amount of 2, 3, 5 or 10.

Another special symbol comprises a wild symbol in the form of a RHINO MANIA symbol 50 that causes the display of RHINO MANIA WILD substitute symbols 53 on the reels 12*a* to 12*e* where a corresponding RHINO MANIA symbol 50 appears in indicators 51 located above each reel 12*a* to 12*e*. The indicators 51 appear above each reel 12*a* to 12*e* in the feature game 9, as best shown in FIGS. 7 and 8. In the feature game 9, the RHINO MANIA symbol 50 also acts as a trigger symbol in that when a RHINO MANIA symbol appears in any of the reels 12*a* to 12*e*, it causes a corresponding RHINO MANIA symbol 50 to appear in each indicator 51 associated with the reel in which the trigger symbol has appeared. The RHINO MANIA symbol 50 that appears in the indicator 51 does not form part of any pay lines 14 in the array 11 played in the feature game 9. However, once a spin of the feature game 9 ends and the RHINO MANIA symbol 50 appears in the bonus reel 30, it causes the reels 12*a* to 12*e* that have a RHINO MANIA symbol 50 in their respective associated indicator 51 to display the substitute RHINO MANIA WILD symbol 53 in each symbol position 13. The RHINO MANIA WILD substitute symbol 53 is unique to the feature game 9 in that it does not appear in the base game 8.

The substitute RHINO MANIA WILD symbol 53 not only acts as a substitute symbol but also provides a win multiplier of ×5. In result shown in FIG. 8, the player has won the maximum prize that can be won, as the RHINO MANIA WILD symbol 53 acts as the highest value game symbol 10 on the array 11 but also multiplies the amount of the win by 5. This also means that the preceding play of the feature game 9 must have resulted in the trigger symbol appearing in at least one symbol position 13 of each reel 12*a* to 12*e* to cause the RHINO MANIA symbol 50 to appear in the indicator 51 of each reel. In addition, other indicators 55 and text messages 57, 59 highlight to the player the significance of the bonus reel 30 in the feature game 9.

In one embodiment, the indicators 51 do not automatically appear in the feature game 9. Instead, the indicators 51 only appear when the RHINO MANIA symbol 50 appears on the reels 12*a* to 12*e* and only for the reel in which the RHINO MANIA symbol 50 has been displayed. For example, if the RHINO MANIA symbol 50 appears in one of the symbol positions 13 of reel 12*a*, then an indicator 51 appears above that reel and no other reel.

Also, in other embodiments, the indicator 51 and the RHINO MANIA symbol 50 that appears in the indicator are merged into a single indicator or indicator symbol. Hence, this indicator or indicator symbol only appears when the RHINO MANIA symbol 50 appears on the reels 12*a* to 12*e* and only for the reel in which the RHINO MANIA symbol 50 has been displayed, as described above.

In another embodiment, the trigger event for the appearance of the RHINO MANIA symbol 50 in the indicator 51 is not tied to the oversized bonus reel 30. In other words, the indicators 51 and the replacement of game symbols 10 with the RHINO MANIA WILD symbol 53 can be implemented without having the use the bonus reel 30. In this case, a different trigger event is used like an in-game event, such as the appearance of three scatter symbols 10*d* or an award of additional free spins of the feature game 9 during game play.

A further embodiment uses the same special symbol as the replacement of the game symbols in the feature game 9. Thus, the RHINO MANIA symbol 50 would be used instead of the RHINO MANIA WILD symbol 53.

In yet another embodiment, not all the game symbols in the reels 12 are replaced by the RHINO MANIA WILD symbol 53. Instead, only game symbols that are not scatter symbols are replaced by the RHINO MANIA WILD symbol 53. In this case, the scatter symbols 10*d* are not replaced because they act as trigger symbols or collector symbols for awarding additional free spins of the feature game 9 and hence should not be replaced. The scatter symbols 10*d* can award the additional free spins immediately once a threshold number of scatter symbols (for example, three scatter symbols) appear on the reels 12. Alternatively, the additional free spins are not awarded immediately but are accumulated and upon the conclusion of the feature game 9, the accumulated additional free spins are then awarded. For example, each time three scatter symbols 10*d* appear on the reels 12, five additional free spins are accumulated. Thus, in this case where three scatter symbols have appeared on the reels 12 three times over the free spins of the feature game 9, fifteen additional free spins are accumulated but not played until the end of the feature game 9. In a further embodiment, the scatter symbols 10*d* act as collector symbols where the player collects or accumulates scatter symbols 10*d* as they appear in the feature game 9 and at the conclusion of the feature game 9, additional free spins of the feature game are awarded if the number of scatter symbols 10*d* meets a threshold number, for example, nine scatter symbols. These additional free spins may include additional game enhancements, such as the RHINO MANIA symbol 50 appearing on each additional free spin, thus increasing the likelihood of obtaining a winning combination by triggering the appearance of the RHINO MANIA WILD symbol 53. Another embodiment uses the scatter symbol as a substitute symbol in the feature game 9 as an alternative or in addition to its function as a trigger symbol and/or collector symbol.

In some embodiments, the special symbols comprise bonus multiplier or wild multiplier symbols that increase the value of any prizes awarded for winning combinations that use any of the substitute symbols. The bonus multiplier symbol increases the prize value by a set amount (such as adding 50 credits to any award prize) while the wild multiplier symbol increases the prize value by a multiple (such as multiplying any award prize in value by 2, 3 or 5).

In the above described embodiments, the probability of a special symbol 35, 49, 50 appearing in the bonus reel 30 depends on the amount of the bet that is made by the player to play the base game 8. Thus, as the amount of the bet increases, the probability of the special symbol 35, 49, 50 appearing in the bonus reel 30 also increases in proportion. This can be achieved by using different reel strips for the bonus reel that have a lower or greater frequency of the special symbols 35, 49, 50 on the reel strip.

In some embodiments, the type of special symbols 35, 49, 50 displayed in the symbol position 33 of the bonus reel 30 varies depending on the amount of the bet made by the player to the play the base game. For example, if the player does not make a bet above a certain threshold amount, the bonus reel 30 in FIGS. 7 and 8 does not show the RHINO MANIA symbol 50.

In one preferred form, the electronic game controller 4 internally determines whether to trigger or activate the feature game 9 instead of using the random display of three scatter symbols 10*d*. In another embodiment, the electronic game controller 4 generates an internal trigger event, such as randomly generating a number between 1 and 10, and activating the feature game 9 if the randomly generated number is in the range of 1 to 4. In an alternative preferred form, the electronic game controller 4 causes triggering of the feature game 9 automatically after each play of the base game 8.

While the preferred embodiment of the invention has been described in relation to a base or main game and a feature game, those skilled in the art will appreciate that the game enhancing elements can readily be applied to the base game in addition to a feature game. Alternatively, there is no feature game and instead the game enhancing elements modify the base game for a predetermined number of games played in the main game. These modified plays of the base game may be free or require payment from the player.

In yet another alternative, the trigger event is a player-actuated event, which can be implemented by using appropriate touch-screen buttons on the display 7 and/or physical buttons 6 on the console 3. The player-actuated trigger event can either be for the feature game 9 or for the activation of the bonus reel 30 in the feature game 9. In this latter case, the electronic gaming controller 4 still determines activation of the feature game 9, but the player determines whether or not to activate the bonus reel 30 in the feature game. In a further preferred form, there are separate player-actuated trigger events for both the feature game 9 and the bonus reel 30.

In each of these preferred forms, it is contemplated that the player would make an ante bet in addition to his or her bet to play the base game 8 to access the ability to activate the feature game 9 and/or the bonus reel 30. Thus, an ante bet may be made to access the ability to activate the feature game 9 at any time, and the same ante bet or an additional ante bet enables access to the bonus reel 30. This can result in a "standard" feature game (not requiring an ante bet but randomly triggered), an enhanced feature game (in that the feature game is player activated) and a further improved feature game having the bonus reel 30 (the feature game 9 and/or bonus reel 30 is player activated). The enhanced and improved feature games would require an ante bet (more than one ante bet) to be made to access these versions of the feature game. It is also contemplated that where there is no feature game but only a "base" game, the ante bet enables the player to access the bonus reel 30 as an enhancement to the game.

While the preferred embodiment has been described using reels 12 comprising columns in an array of rows and columns, it will be appreciated that the invention can equally applied to reels that comprise a single symbol position, the reels being arranged in an array of rows and/or columns of individual reels. For example, in a 5×3 array, there would be fifteen reels instead of five reels.

In other preferred forms, the base game 8 and feature game 9 need not be displayed on a single video screen 7. Instead, they may be displayed on separate video screens, with the reels 12 of the array 11 for the base game 8 and feature game 9 appearing in a lower video screen and the second array or bonus reel 30 appearing on an upper video screen.

In another preferred form, the video screen 7 is a touch screen for use as an alternative or in addition to the player-actuatable buttons 6 so as to enable the player to select various features, such as making monetary bets for the base game, initiating play of the base and feature games played and responding to any messages or requests issued on the electronic gaming machine 1 by the electronic game controller 4. In this case, the player may control when the reels 12 start spinning and stop spinning, either individually or collectively, by simply touching the reel(s) 12. Likewise, the player may control when the bonus reel 30 starts spinning and stops by also touching the bonus reel 30. Control over spinning of the reels 12 can also be implemented through the buttons 6 on the console 3. This increases player interaction and provide the player with an opportunity to guess when a particular game symbol 10 may appear in the reel 12 or a special symbol 35 of higher value appears in the symbol position 33 of the bonus reel 30.

It will be appreciated that while the preferred embodiments have been described in relation to an industry standard electronic gaming machine, the invention can be readily applied to other types of electronic gaming machines, including a personal computer (standing alone or connected to a communications network, LAN or WAN, WLAN), mobile electronic devices (such as handheld or portable electronic devices like tablets and smart phones) and other electronic devices capable of displaying a game. In the case of mobile electronic devices, in one arrangement the mobile electronic device may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. A further arrangement would not require any monetary transaction at all. Similarly, the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer program configured to perform the invention. In this way the invention can be implemented in various ways on an electronic gaming machine. In a further aspect, the invention includes a gaming system configured comprising a central processing unit (such as a computer or computational processor) configured for communication with an electronic gaming machine to perform the invention. In a yet another aspect, the invention includes a non-transitory carrier medium carrying computer executable code that, when executed on a central processing unit configured for communication with an electronic gaming machine, causes said central processing unit to perform the invention. In this case, the non-transitory carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the embodiment in FIGS. 3 and 4 may use the win multiplier symbol 49 and the equivalent of the RHINO MANIA symbol 50 for the bonus reel 30 in addition to the Chinese zodiac symbol 35. Similar combinations of two or more features from the above described embodiments or preferred forms of the invention can be readily made by one skilled in the art.

By providing a second array that confers game enhancing elements which affect the outcome of a game playing in as first array, this aspect of the invention introduces a variety in game play and game mechanics for a player, thus increasing the player's excitement and retaining his or her interest in playing the same electronic gaming machine. Also, the larger size of the symbol position for the second array creates a significant visual impression upon the player during game play, thus increasing player excitement and interest in playing the game on the first array so as to secure the game enhancing element awarded by the second array. Similarly, by providing an indicator that is associated with a reel in a reel-type game, and which results in the changing of at least one game symbol in the associated reel, this aspect of the invention also introduces variety in game play and enhances player excitement as the presence of the indicator means that it is more likely that the player will receive an award or an award of higher value. All these advantages of the invention result in the player being more likely to retain interest in continuing to play the same electronic gaming machine due to the variation in game play on the electronic gaming machine. Furthermore, since the electronic game controller controls operation of the electronic gaming machine, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a housing having a display for displaying a game and an electronic game controller for controlling the display of said game symbols in said game on said display, wherein said game comprises game symbols displayed in one or more symbol positions arranged into a plurality of reels, where predetermined winning combinations of game symbols in said game award prizes to a player; and an input means for receiving commands from said player to operate said electronic gaming machine and initiate play of said game on said display, said input means being in electronic communication with said electronic game controller;

wherein said electronic game controller in response to a command from said player via said input means commences play of said game by randomly selecting game symbols and transmitting a signal to said display to display said randomly selected game symbols in said symbol positions on said reels;

wherein said electronic game controller randomly determines whether to display at least one special symbol in said game;

wherein the appearance of said at least one special symbol in at least one reel of said plurality of reels in a play of said game causes said electronic game controller to transmit a signal to said display to display an indicator associated with said at least one reel for one or more subsequent plays of said game;

said electronic game controller randomly determines whether a trigger event is to occur in said one or more subsequent plays; and whereupon the occurrence of said trigger event, said electronic game controller transmits a signal to said display to replace at least one game symbol in said at least one reel associated with said indicator with another special symbol, and said electronic game controller causes said display to show a bonus reel separate to said reels, said trigger event comprising the appearance of said at least one special symbol in said bonus reel.

2. The electronic gaming machine of claim 1, wherein said at least one game symbol is not a scatter symbol.

3. The electronic gaming machine of claim 1, wherein said at least one game symbol comprises all the game symbols in each symbol position of said at least one reel.

4. The electronic gaming machine of claim 1, wherein said another special symbol comprises a substitute symbol.

5. The electronic gaming machine of claim 4, wherein said substitute symbol also multiplies by an integer any award given by said electronic gaming machine for a winning combination of game symbols that includes said substitute symbol.

6. The electronic gaming machine of claim 1, wherein said bonus reel comprises a symbol position that visually appears greater in size than said symbol positions of said reels.

7. The electronic gaming machine of claim 1, wherein said trigger event comprises the award of additional plays of said game.

* * * * *